US005833096A

United States Patent [19]

Ohu

[11] Patent Number: 5,833,096

[45] Date of Patent: Nov. 10, 1998

[54] WATER DISPENSER

[75] Inventor: H. B. Ohu, Seoul, Rep. of Korea

[73] Assignee: Dasan C&I Co. Ltd., Seoul, Rep. of Korea

[21] Appl. No.: 911,131

[22] Filed: Aug. 14, 1997

Related U.S. Application Data

[63] Continuation-in-part of Ser. No. 697,717, Aug. 29, 1996, abandoned.

[30] Foreign Application Priority Data

Aug. 31, 1995 [KR] Rep. of Korea ..... 1995 28200
Aug. 8, 1996 [KR] Rep. of Korea ..... 1996 23935

[51] Int. Cl.[6] ..... B67D 5/62

[52] U.S. Cl. ..... 222/146.1; 222/325; 222/609; 141/231; 280/79.5

[58] Field of Search ..... 222/183, 146.1, 222/325, 160, 609; 141/231, 375; 280/79.5, 79.11

[56] References Cited

U.S. PATENT DOCUMENTS

| | | | |
|---|---|---|---|
| 2,105,990 | 1/1938 | Schultz et al. | 222/325 |
| 2,212,749 | 8/1940 | Pelcuch | 222/609 |
| 3,269,143 | 8/1966 | Gasparovich . | |
| 3,698,454 | 10/1972 | Cunha et al. | 141/375 |
| 4,958,747 | 9/1990 | Sheets . | |
| 5,540,355 | 7/1996 | Hancock et al. . | |

*Primary Examiner*—Philippe Derakshani
*Attorney, Agent, or Firm*—Evers & Hendrickson; Jay P. Hendrickson, Esq.

[57] ABSTRACT

A water dispenser for dispensing bottled water with the water bottle installed into the bottom portion of a dispenser cabinet with the water bottle's open end up, thereby eliminating the need to lift the water bottle to the top of the cabinet and the need to invert the bottle so that its open end points down.

9 Claims, 9 Drawing Sheets

WATER DISPENSER

This Application is a Continuation-In-Part application of U.S. Ser. No. 08/697,717, filed Aug. 29, 1996 now abandoned, claiming foreign priority in reference to applications filed on Aug. 31, 1995, and Aug. 8, 1996.

BACKGROUND OF THE INVENTION

1. Field of the Invention

This invention relates generally to hot and cold water dispensers, and more specifically to an improved hot and cold water dispenser which allows the user to install a water container or water bottle into the bottom portion of a dispenser cabinet, rather than on top of the cabinet.

2. Description of the Prior Art

The demand for bottled mineral water has increased over the last several years. This demand has most likely increased due to the public's awareness of impurities in the public water supply. As a result of this increased demand, water dispensers have been introduced into the market place to enable users to obtain hot and cold water from a single five gallon bottle. To date these conventional water dispensers have adopted the same cooling method utilized in refrigerators and freezers in which a compressor condenses Freon gas, or other similar CFC gas, which circulates in cooling coils in order to cool the water. Due to the space requirements of the condenser and coiling coils, conventional water dispensers have located the cooling apparatus in the water dispenser's cabinet, leaving no room for the water bottle. Thus, these conventional dispensers are designed such that the water bottle must be placed on top of the water cabinet, rather than inside of the cabinet. As a result, many potential users, especially senior citizens, are reluctant to make use of this type of water dispenser because the five gallon water bottle is too heavy to lift up to the top of the cabinet. In addition to this difficulty, since the water bottle must be placed on top of the cabinet with the bottle's open end down, it is inevitable that water will occasionally spill onto the cabinet and floor. This conventional design also does not provide any means for sealing the open water bottle in order to prevent contamination. Moreover, other sanitary problems may arise because the user must grab the open end of the water bottle when placing the bottle upside down on top of the cabinet. In addition to these inconveniences and sanitary problems, CFC gases are known to be contributors to the depletion of the ozone layer in the earth's upper atmosphere.

SUMMARY OF THE INVENTION

The present invention provides a water dispenser which is easier to use than a conventional dispenser because the invention permits the user to install a heavy five gallon water bottle into the bottom portion of the dispenser's cabinet, rather than on top of the cabinet. The invention is more sanitary than a conventional water dispenser because the invention allows the water bottle to be installed with its open end up, thus eliminating spilling, and when in operation, the water bottle's opening is sealed to prevent contamination from the environment. The invention has the further advantage in that it cools the water without using CFC gases which are known to deplete the atmosphere's ozone layer.

DETAILED DESCRIPTION OF THE INVENTION

Figure 1:
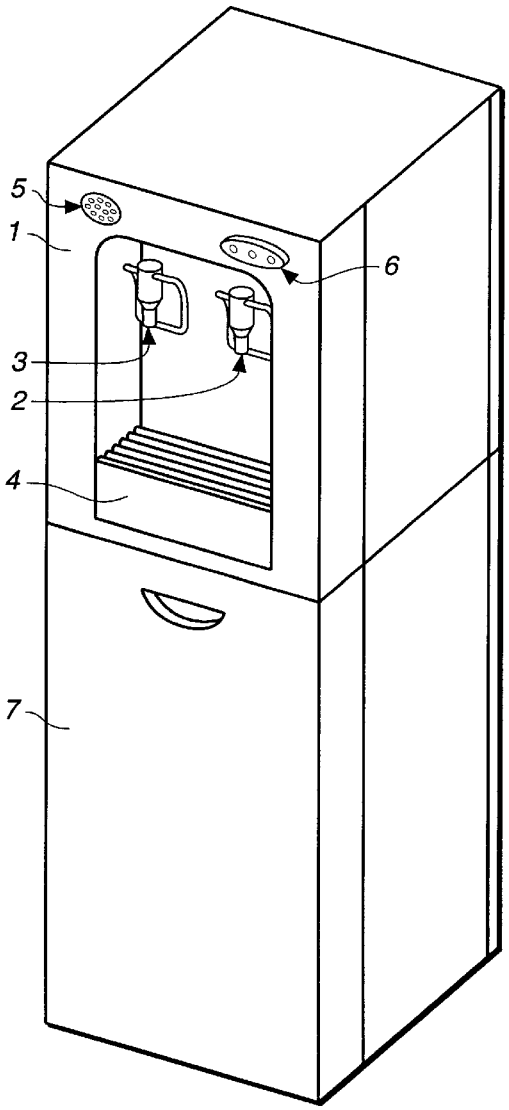
FIG. 1 is a perspective view of the front portion of this invention, illustrating that hot and cold water dispensers are located near the top of a water dispenser cabinet, and that a water bottle, obscured from view within the cabinet, is located in the bottom portion of the cabinet
Figure 2:
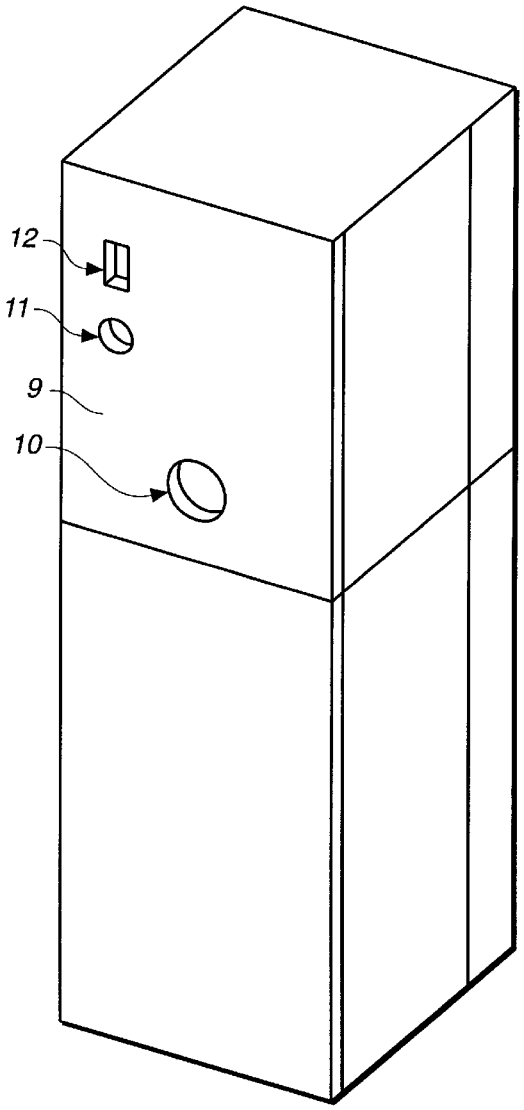
FIG. 2 is a perspective view of the rear portion of this invention.
Figure 3:
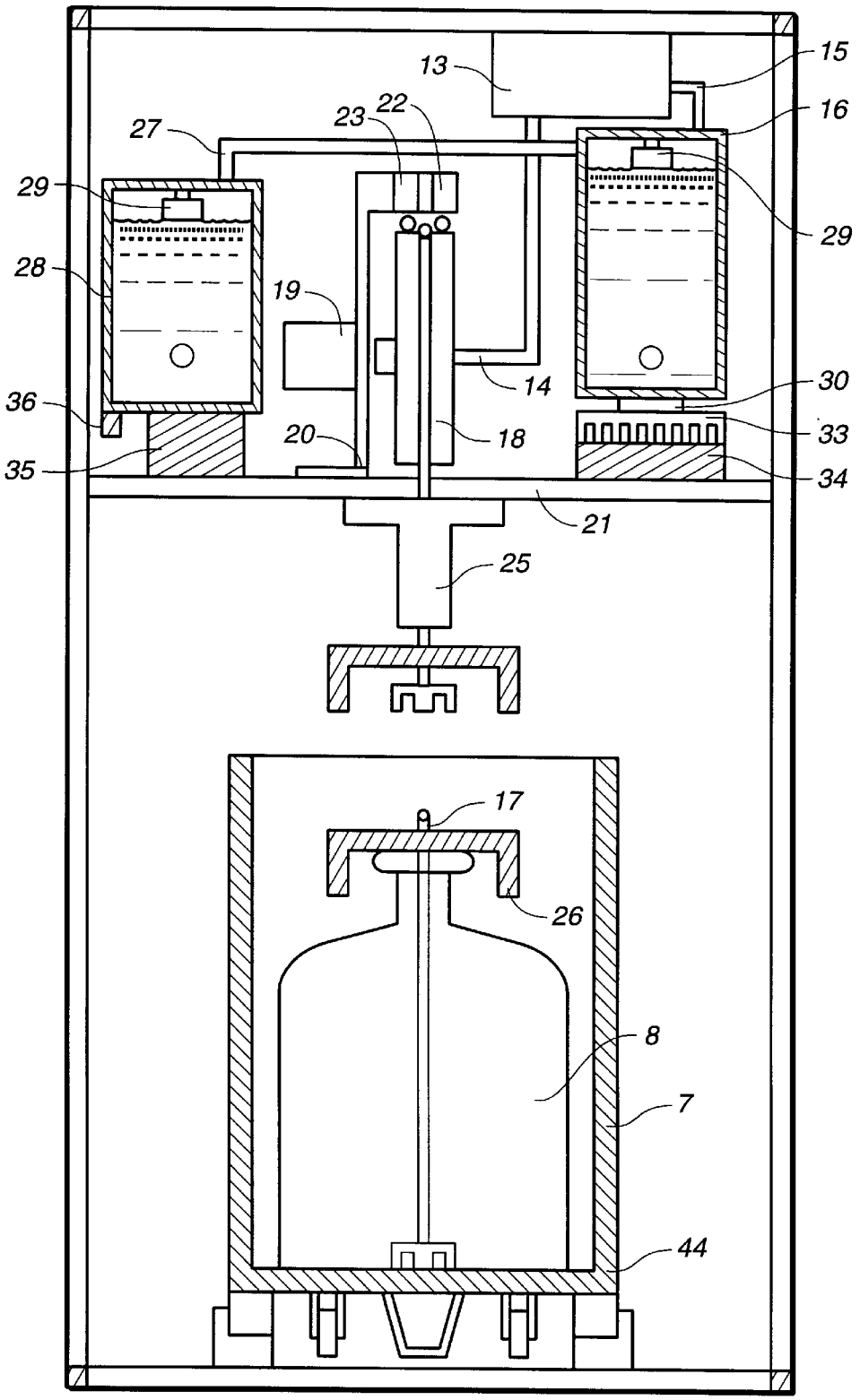
FIG. 3 is a cross-sectional view of the invention, which illustrates the arrangement of the invention's interior elements as viewed from the front.
Figure 4:
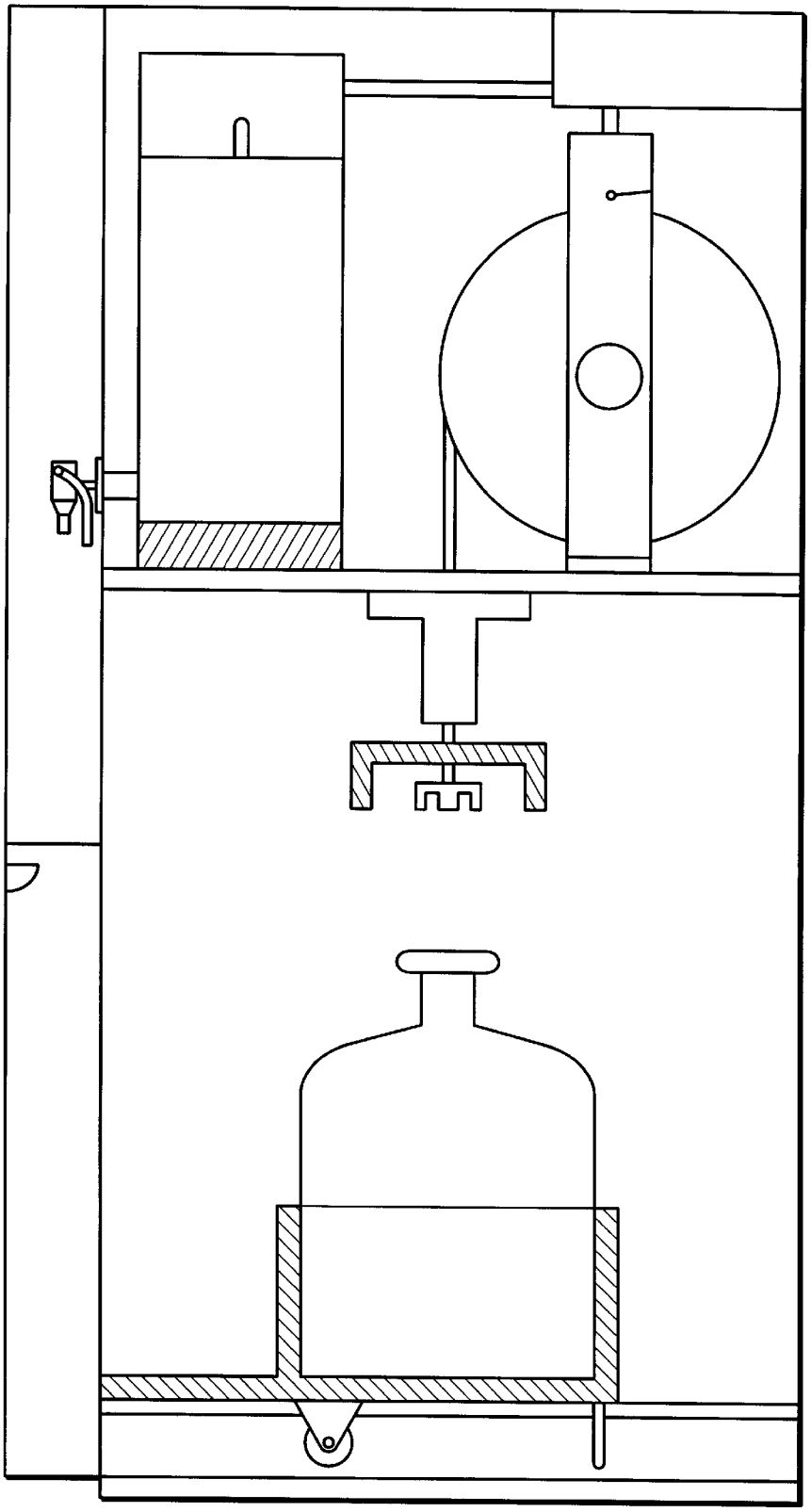
FIG. 4 is a cross-sectional view of the invention, which illustrates the invention's interior elements as viewed from the side.
Figure 5:
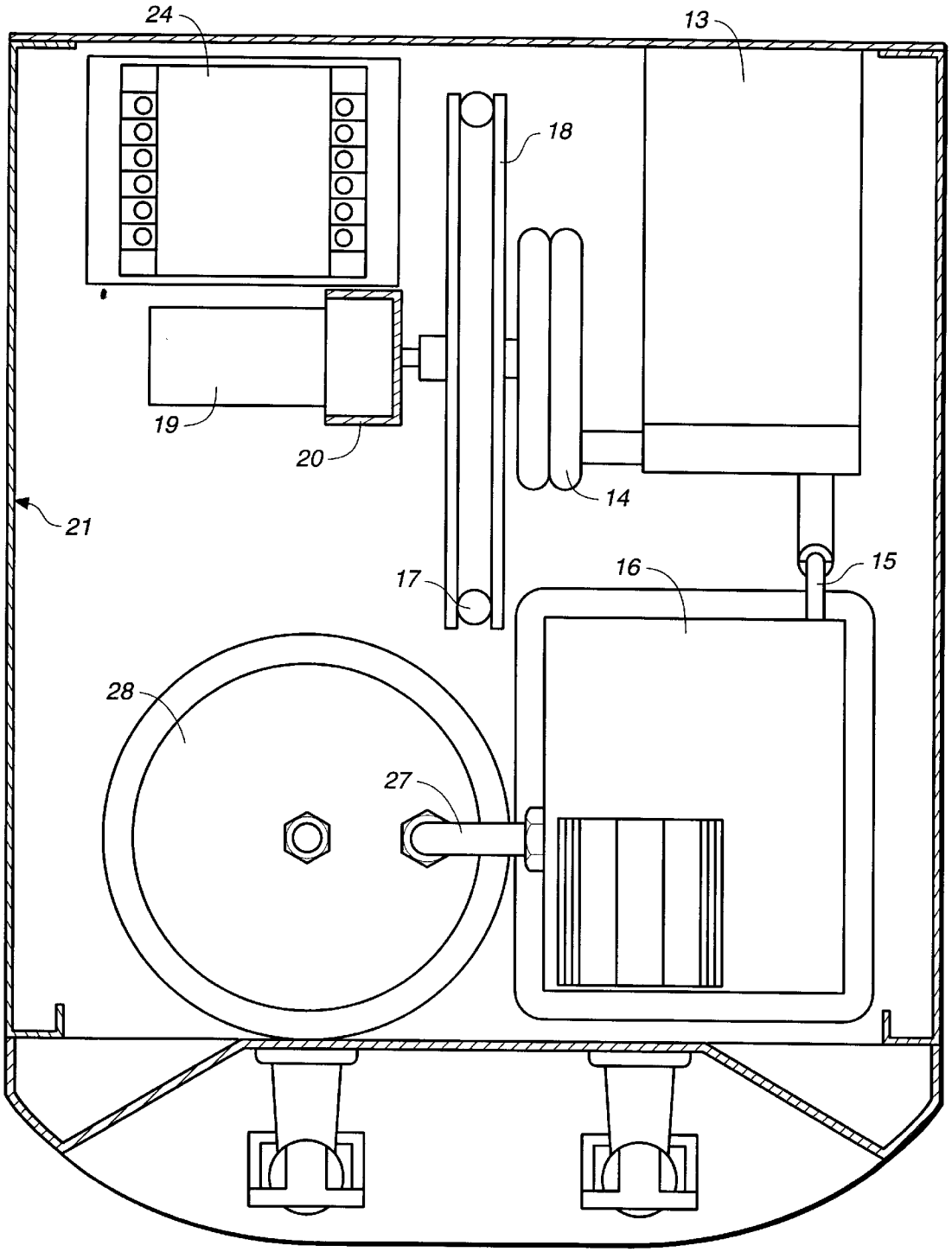
FIG. 5 is a cross-sectional view of the invention, which illustrates the invention's interior elements as viewed from the top.
Figure 6:
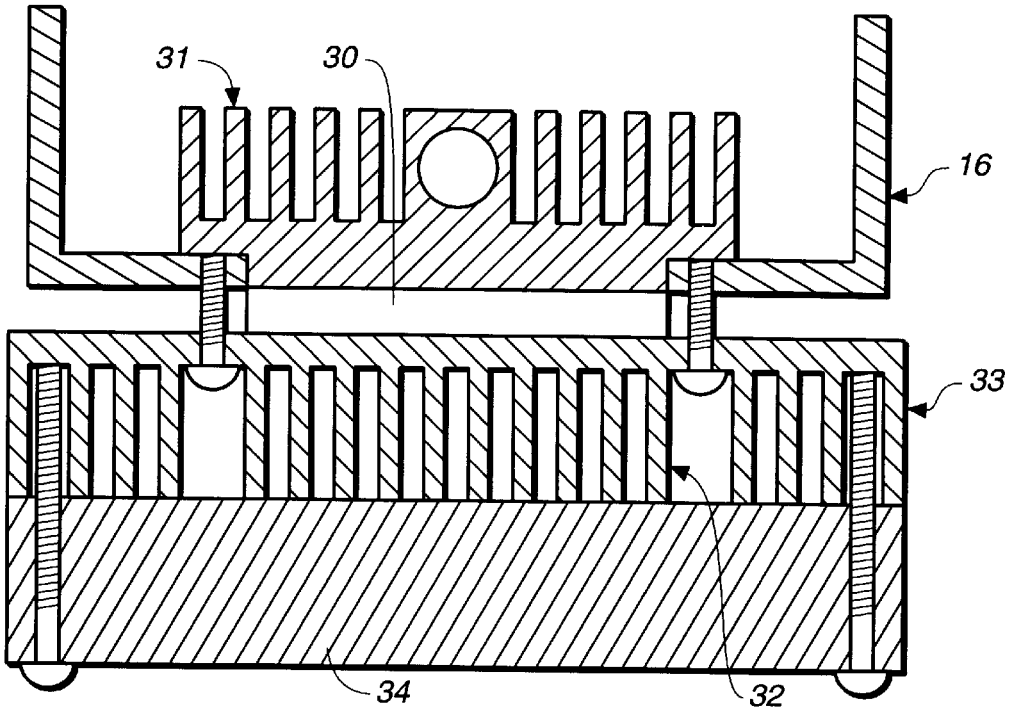
FIG. 6 is a partial elevational view of a cooling device which is located in the upper portion of the cabinet.
Figure 7:
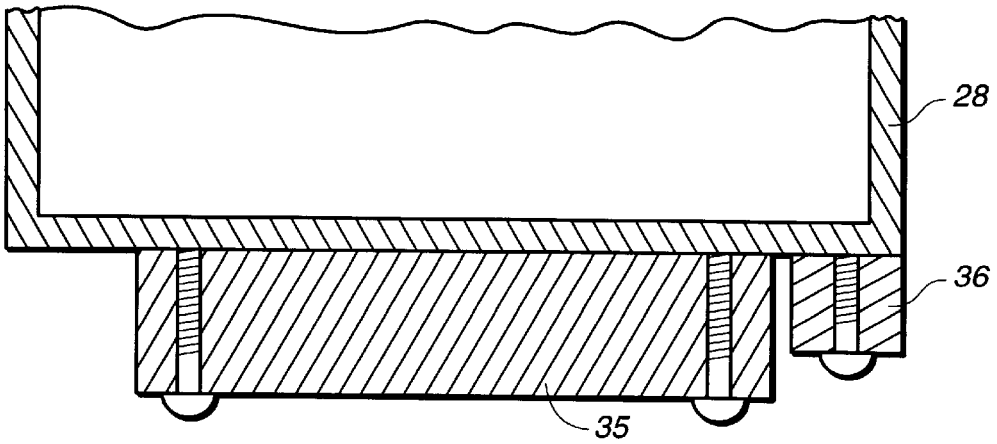
FIG. 7 is a partial elevational view of a heating device also located in the upper portion of the cabinet.
Figure 8:
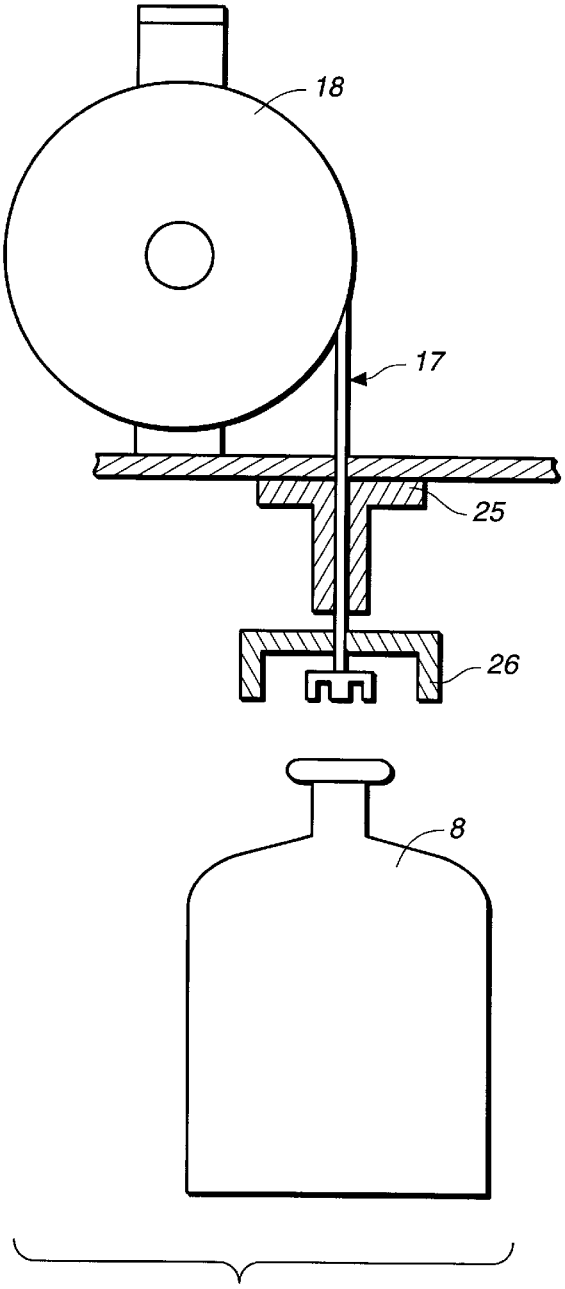
FIG. 8 is a partial elevational side and of a pulley assembly and absorption tube which are positioned inside of the cabinet and above the water bottle.
Figure 9:
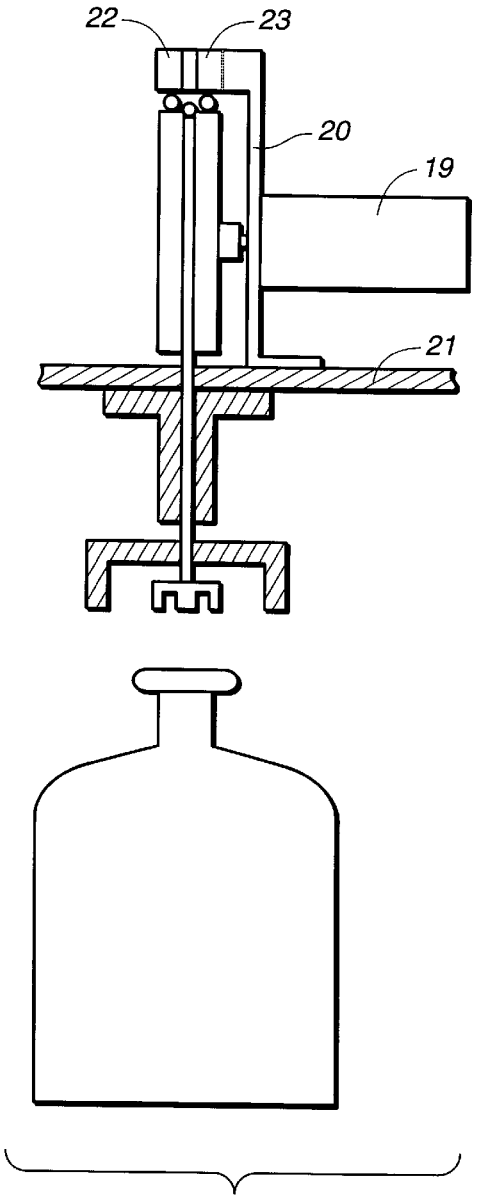
FIG. 9 is a partial front view of said pulley assembly and absorption tube.
Figure 10:
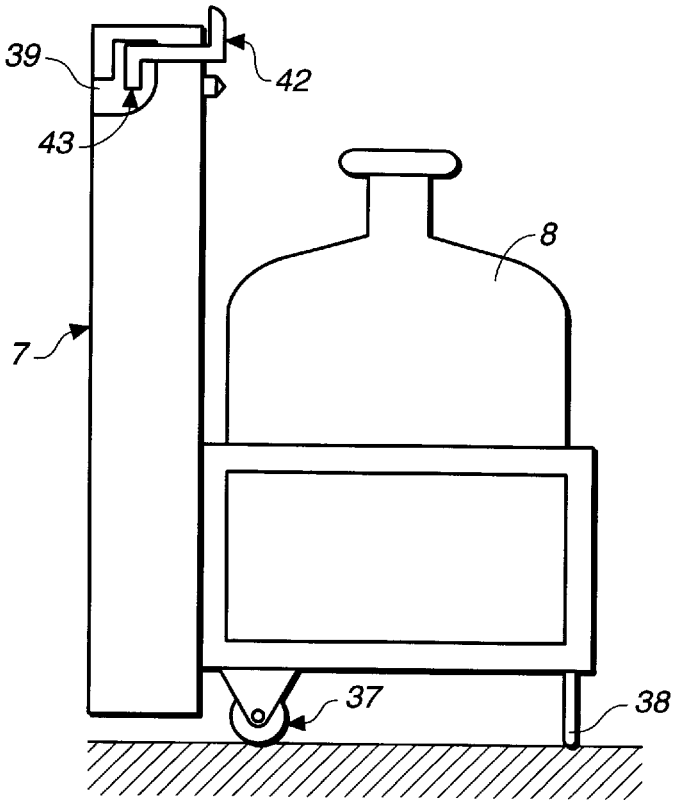
FIG. 10 is a partial elevational view of a cart when pulled out of the cabinet, said cart utilized to hold the water bottle with its open top end up.
Figure 11:
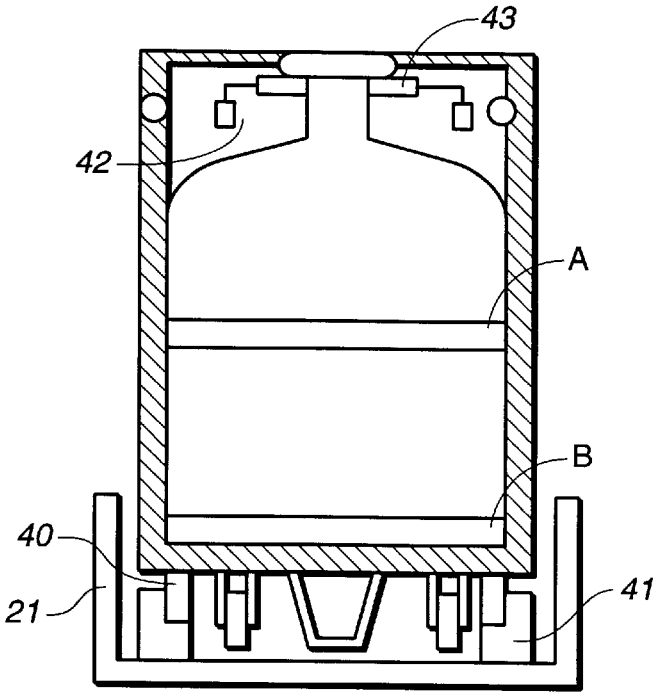
FIG. 11 is a partial elevational view of the cart when pushed into the cabinet.
Figure 12:
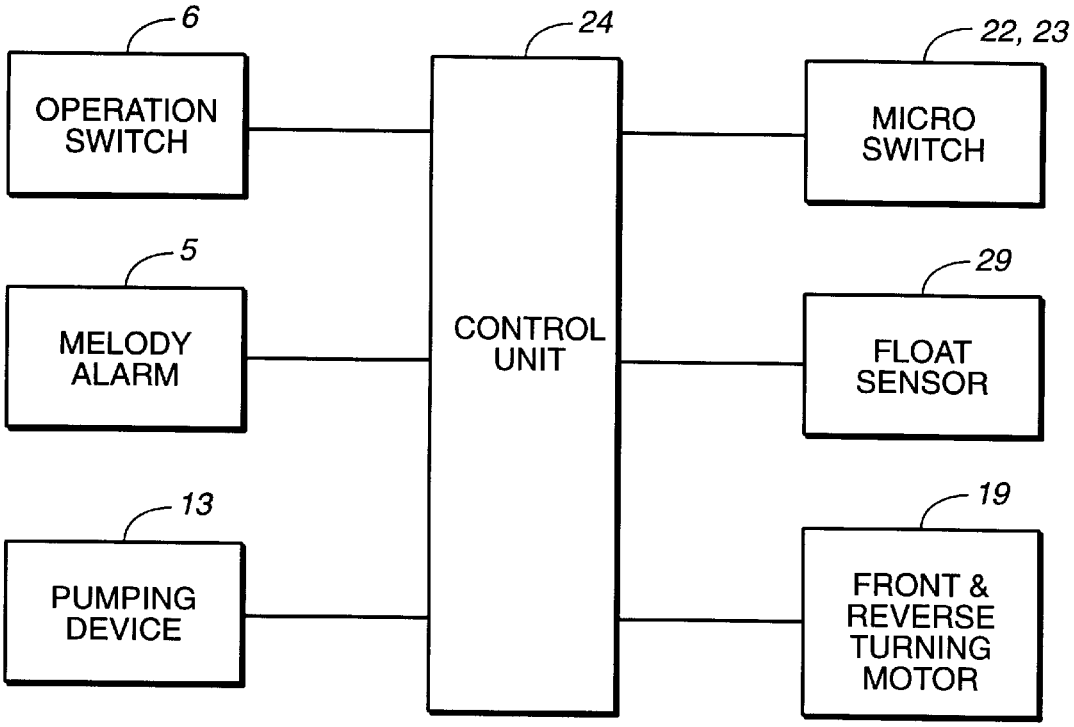
FIG. 12 is a schematic lay-out of an electric circuit which is provided to operate a pumping device, a melody alarm, an operation switch and a forward and reverse turning motor.
Figure 13:
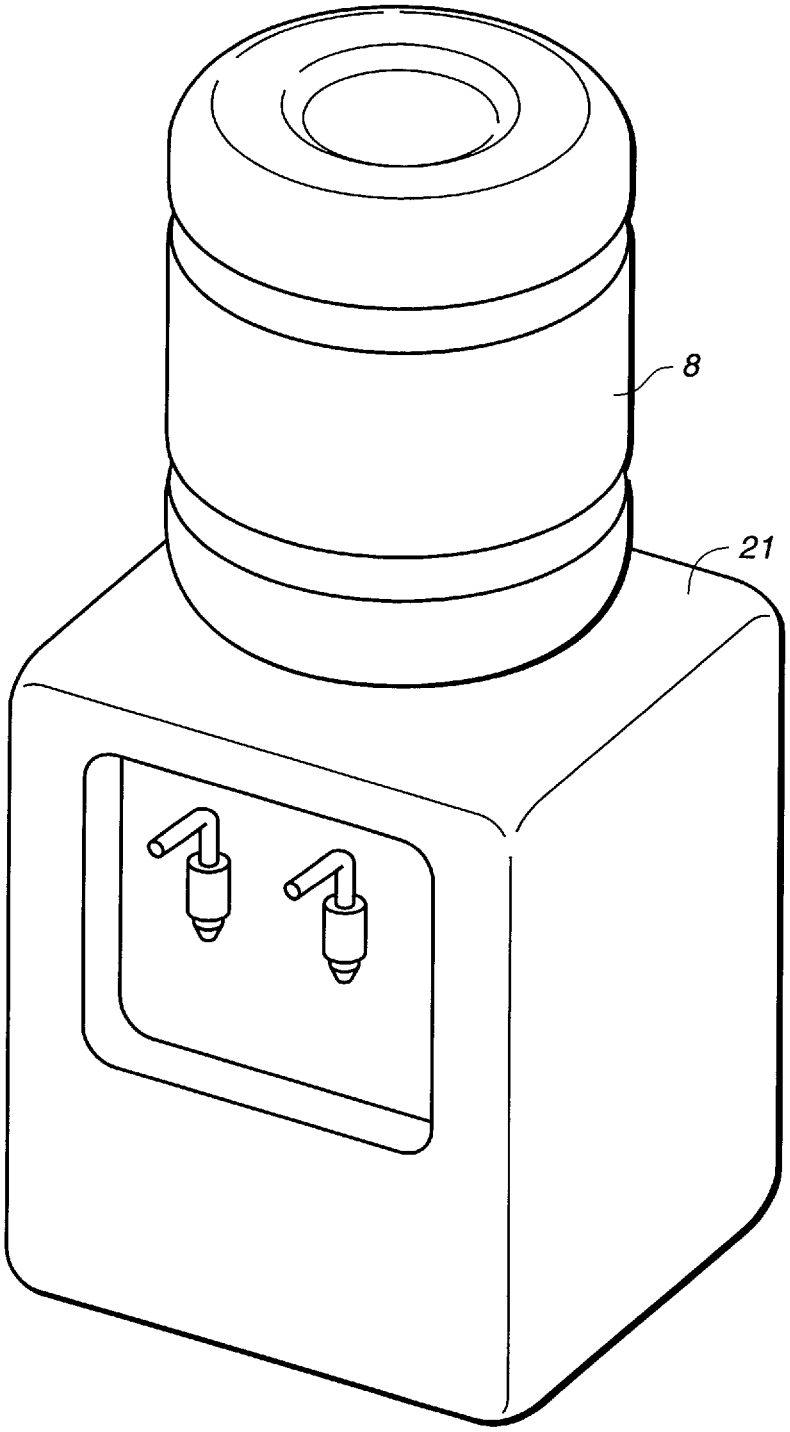
FIG. 13 (PRIOR ART)
FIG. 13 is a perspective view of a conventional water dispenser, which depicts some of the prior art.

A typical embodiment of the invention is illustrated in the perspective views of FIG. 1 and the cross-sectional views of FIGS. 2, 3 and 4.

The front perspective view of FIG. 1 shows a water dispenser cabinet as it appears to the user. An upper front panel 1 contains an operation switch with LED's 6 and a melody alarm 5 to warn the user of the need to supply a replacement water container or water bottle. A first faucet 2 for hot water and a second faucet 3 for cold water are also located on the upper front panel, and a saucer 4 is positioned beneath the faucets in order to collect water that may spill when the user operates the faucets. A cart panel 7 is located immediately adjacent to and beneath the upper front panel. The rear perspective view of FIG. 1 illustrates the water dispenser as it appears from the rear. An upper back panel 9 contains a power cord port 10, a fuse 11, and an on/off switch 12.

The cross-sectional views of FIGS. 2, 3 and 4 illustrate the inside portion of the water dispenser cabinet. The inside of the cabinet is divided into a top and bottom portion separated by a middle shield panel 21. A moveable cart assembly 44 shown on FIGS. 3, 4, 10 and 11 is positioned in the bottom portion of the cabinet, said cart assembly containing the cart panel 7 with an outside surface and an inside surface, said outside surface containing a built-in handle opening 39. A lever 43 is located within the handle opening, said lever releasably connected to a pair of locks 42 which are released when the handle is grabbed to pull the moveable cart assembly out of the water dispenser cabinet. A pair of casters 37 are connected to the bottom, front portion of the cart assembly and a strut 38 member is connected to the bottom rear portion of the assembly. A pair of top horizontal cart guide rails 40 are attached to the inside surface of the cart panel and a pair of bottom horizontal cabinet guide rails 41 are attached to the bottom of the cabinet assembly, said top and bottom rails positioned such that the top rails slide along the bottom rails when the cart is pulled out of the cabinet and pushed into the cabinet.

A water container or water bottle 8 containing an open end is positioned inside of the moveable cart with the bottle's open end up. An upper elongated fastener A and a lower elongated fastener B are each connected to the moveable cart assembly frame to prevent the water bottle from swaying.

A pulley 18 is located in the top portion of the cabinet and attached to the middle shield panel by means of a guide bracket 20, said pulley having a flexible absorption tube 17 partially wound around the pulley with a first end of the tube positioned so as to permit it to pass through a circular opening in the middle shield panel and through a circular opening in an absorption tube guide 25 located adjacent to the underside of the shield panel and concentric with the middle shield panel opening. When the moveable cart and water bottle are positioned inside of the water dispenser cabinet, the first end of the absorption tube is located directly above and in an axial position relative to the center of the water bottle's open end. A sealing cap 26 is connected to the first end of the absorption tube so that the open end of the water bottle is sealed when the absorption tube is inserted into the bottle.

A forward and reverse turning motor 19 is mounted to the guide bracket and axially connected to the pulley, said motor's operation being electrically controlled by a forward micro-switch 22 and a reverse micro-switch 23, both switches located on the guide bracket and above the pulley.

A second end of the absorption tube is connected to one end of a spiral hose 14, said spiral hoses's other end connected to an electrically controlled pumping device 13, said pumping device connected to a cold water tank 16 by means of a first connection pipe 15. A second connection pipe 27 connects the cold water tank to a hot water tank 28. A pair of float sensors 29 are provided to sense the water level in each tank.

A thermo-electric module 30 is attached to the bottom of the cold water tank, said module containing a cooling pin 31, a first heat sink 32 and a second heat sink 33 and a fan 34. An electrically controlled die casting heater 35 is attached to the bottom of the hot water tank and the temperature range is controlled by a thermostat 36.

An electrically operated control unit 24 controls the operation of the forward and reverse turning motor, micro-switches, float sensors, pumping device, melody alarm and operation switch.

The water dispenser is operated by pulling the moveable cart out of the water dispenser cabinet by lifting the lever located within the handle opening. This action releases the locks, which permits the cart to be rolled out of the cabinet, being guided by the cabinet and cart rails. Once the cart is pulled out of the cabinet a sufficient distance, a water bottle may be placed inside the cart with the bottle's open end up. The bottle is secured in the cart by using the upper and lower fasteners. Once the bottle is securely placed inside the cart, the cart is pushed back inside the cabinet. The absorption tube is inserted into the bottle by turning on the operation switch which activates the forward and reverse turning motor. When the motor turns forward, it causes the pulley to rotate which lowers the absorption tube's first end into the water bottle. The absorption tube's vertical movement is controlled by the forward micro-switch which is set to turn off the motor when the tube reaches the bottom of the bottle. When the absorption tube is fully extended, the sealing cap seals the open end of the bottle. At this point, the pump is activated which pumps the water from the bottle up into the cold water tank and eventually into the hot water tank. The float sensor in each tank senses the water level and sends a signal to the control unit to cause the pump device to pump water until both tanks are full.

When a user operates the faucets to obtain water from the hot or cold tanks, pump activation of the pumping device will be delayed by the control unit for a pre-determined time so that any resultant pumping noise occurs after the user has left the vicinity of the water dispenser.

When the water in the bottle is completely emptied, the hot and cold water tank water levels will then fall below certain pre-set valves. When this occurs, the pumping device will stop operating and a signal from the control unit will cause the melody alarm to send a warning that the water bottle is empty. The user then operates the operation switch to raise the absorption tube out of the water bottle to permit the cart and the empty bottle to be removed from the cabinet.

What is claimed is:

1. A water dispenser for use with a water container or water bottle, said water dispenser comprising:

A water dispenser cabinet of sufficient size to contain the water bottle, said water bottle positioned inside of the cabinet with the bottle's open end up, said cabinet further containing a pumping device, a pulley, and a flexible absorption tube with a first end and a second end, said absorption tube partially wound around the pulley, said pulley providing a means for inserting the first end of said tube into the open end of the water bottle and a means for retracting the tube from the bottle, said tube's first end containing a sealing cap providing a means for sealing the water bottle's open end when the tube is fully inserted into the bottle, said tube's second end flexibly attached to solid pumping device providing a means for pumping water out of the bottle and into a water tank, said water tank connected to means for dispensing water to a user.

2. The water dispenser of claim 1 further comprising a moveable cart assembly providing a means for holding the water bottle with its open end up and a means for pulling the water bottle out of the cabinet and pushing the bottle into the cabinet.

3. The water dispenser of claim 2 in which the water tank and dispensing means comprise a hot water tank and a cold water tank, each tank provided with a means for respectively heating and cooling the water and a means for dispensing the hot and cold water.

4. The water dispenser of claim 3 in which the cooling means comprises a thermo-electric module, a cooling pin, a first and a second heat sink, and a fan.

5. The water dispenser of claim 4 in which the heating means comprises an electric die casting heater and a thermostat.

6. The water dispenser of claim 5 further containing an operation switch which electrically controls a forward and reverse turning motor which is axially connected to the pulley.

7. The water dispenser of claim 6 further containing a forward micro-switch and a reverse micro-switch providing the means for controlling the absorption tube's vertical movement.

8. The water dispenser of claim 7 further containing a pair of float sensors providing a first means for sending a signal to the pumping device to cause it to pump water until the hot and cold water tanks are full, a second means for sensing that the water level in each tank has fallen below a certain pre-set value indicating that the water bottle is empty, and a third means for activating a melody alarm to warn the user that the water bottle is empty.

9. The water dispenser as recited in claim 8, in which the first means for sending a signal to the pumping device further comprises a delay means to delay pump activation of the pumping device for a pre-determined time interval.

* * * * *